United States Patent [19]

Matthys

[11] 4,201,129

[45] May 6, 1980

[54] MACHINE FOR CHARGING FURNACES

[75] Inventor: Pierre Matthys, Marne la Coquette, France

[73] Assignee: Etablissements Matthys and Societe G.A.R.A.P., Rouen, France

[21] Appl. No.: 26,756

[22] Filed: Apr. 3, 1979

[51] Int. Cl.[2] ..... B30B 7/00

[52] U.S. Cl. ..... 100/233; 100/295; 110/223; 110/255; 414/173; 414/198

[58] Field of Search ..... 100/233, 295; 110/223, 110/255; 414/173, 198

[56] References Cited

U.S. PATENT DOCUMENTS

| | | | |
|---|---|---|---|
| 3,513,768 | 5/1970 | Altmann | 100/233 X |
| 3,559,823 | 2/1971 | Ostrin | 414/173 |
| 3,621,774 | 11/1971 | Dedio | 414/198 X |
| 3,685,437 | 8/1972 | Panning | 100/233 X |
| 3,855,950 | 12/1974 | Hughes | 110/255 X |
| 4,018,169 | 4/1977 | Schmalz | 100/233 X |

FOREIGN PATENT DOCUMENTS

| | | | |
|---|---|---|---|
| 1244682 | 7/1967 | Fed. Rep. of Germany | 100/233 |

*Primary Examiner*—Billy J. Wilhite

*Attorney, Agent, or Firm*—Haseltine, Lake & Waters

[57] ABSTRACT

A machine for charging a furnace with scrap to be incinerated comprising a hopper in which bulk scrap to be incinerated is fed and whose bottom opens into the interior of a rectilinear and horizontal tubular body connected at one extremity to the inlet of a furnace. Mounted at the other opposite extremity of the tubular body is a push member actuated by a first jack. The push member has a section corresponding to that of the interior passage in the tubular body. A first wall of the hopper is constituted by a trap door capable of being raised to uncover a crushing head articulated by a second jack of high power so that in lowered position it compresses the scrap against the bottom of the tubular body. A second wall of the hopper is disposed opposite the first wall and is pivotably connected to the base of the hopper for undergoing pivotal movement to a lowered position closing the top of the tubular body.

6 Claims, 3 Drawing Figures

MACHINE FOR CHARGING FURNACES

FIELD OF THE INVENTION

The present invention relates to a machine adapted for charging a furnace such as an incinerator, with various types of scrap material without it being necessary to sort or prepare the material prior to its burning.

PRIOR ART

In the incineration of scrap, in general, and industrial scrap, in particular, there are serious problems presented by the sorting of the scrap and by its charging into the furnace. In fact, it is conventional to find in the same scrap vessel objects as varied as containers which are empty or partly filled with sheet metal or plastic containing nonextractable paste or solid products, debris from pallets, construction materials, such as masonary waste, heat insulating material, pieces of scrap iron, more or less agglomerated pulverulent products, cardboard, grease paper, rags, tires etc.

This scrap can only be introduced into the furnace after it has been separated and reduced to small fragments before burning. However, such operations require the use of specialized workmen and the utilization of costly means, such as grinders and jacks.

SUMMARY OF THE INVENTION

An object of the present invention is to provide apparatus which overcomes these disadvantages by providing a machine adapted to prepare scrap for its introduction into a furance without any need for sorting the scrap.

The machine according to the invention is characterized in that it comprises a hopper into which is introduced, in bulk, the scrap to be incinerated and the bottom of which opens into the interior of a rectilinear, horizontal tubular body connected at one extremity to the inlet of the furnace and at the opposite extremity of which there is slidably mounted, under the action of a first jack, a push member of section corresponding to that of said interior passage, a first wall of the hopper being constituted by a trap door capable of being raised to expose a crushing head articulated to the base of the hopper and actuated by a second jack of high pressure such that in lowered position the crushing head compresses the scrap against the bottom of the tubular body, a second wall of the hopper being articulated at its lower edge and being actuated by a third jack between a raised position where it forms a wall of the hopper and a lowered position where it completes the upper wall of the interior passage of the tubular body.

Advantageously, the crushing head has a section substantially equal to that of the bottom of the hopper and it includes projecting hard pins capable of piercing solid waste such as metallic drums or containers.

Thus, after the charging of the hopper, the crushing head is lowered thereby crushing the scrap and compressing the same against the bottom of the interior passage of the tubular body. The push member than feeds the compressed scrap towards the furnace.

An embodiment of the invention will hereafter be described with regard to the attached drawings.

DETAILED DESCRIPTION

Figure 1:
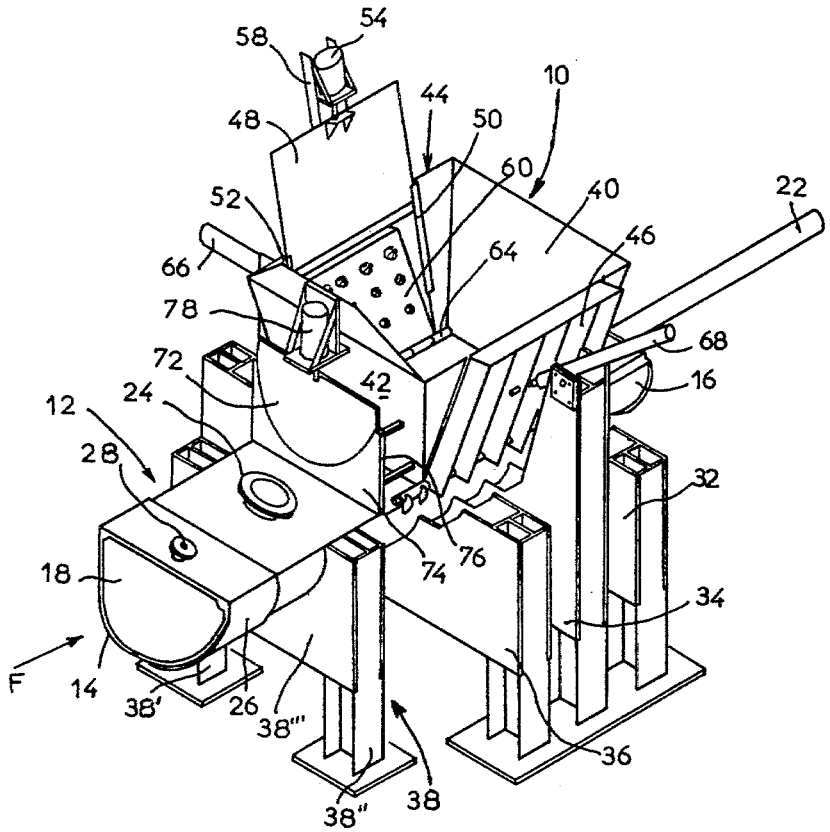
FIG. 1 is a perspective view of a machine according to the invention.
Figure 2:
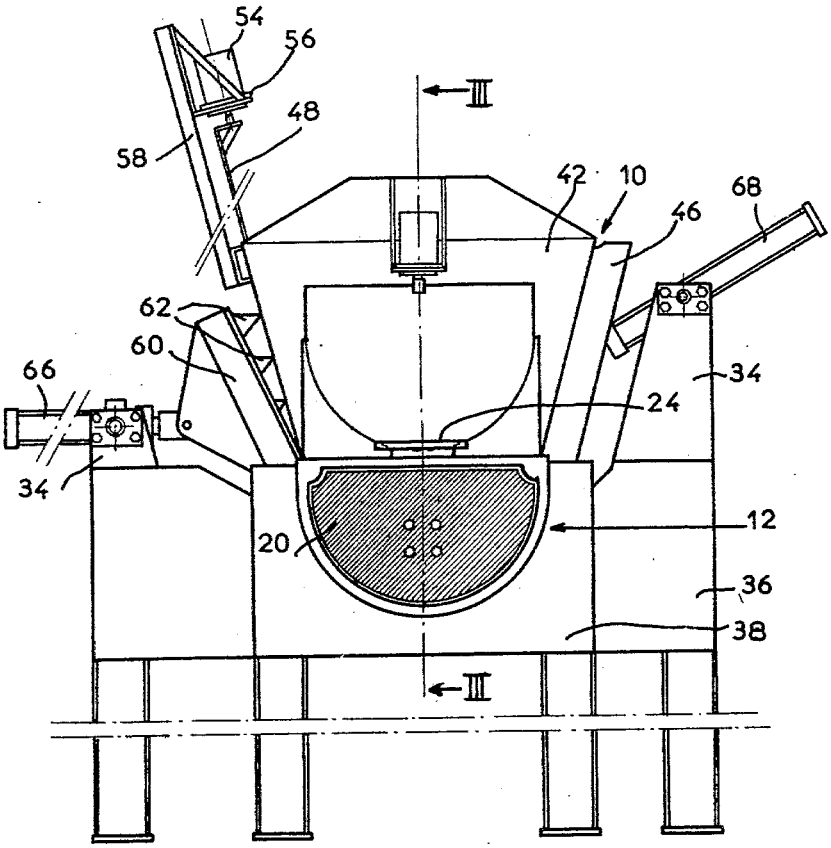
FIG. 2 is an elevational view of the machine taken in the direction of the arrow F in FIG. 1.

Referring to the drawing, the machine according to the invention comprises a hopper 10 into which scrap is fed in bulk by any suitable transport apparatus. The hopper 10 is disposed above a horizontal and rectilinear tubular body 12 connected by one of its end portions 14, situated downstream of the hopper, to an incineration furnace (not shown). The opposite end portion 16 of the tubular body 12 is disposed upstream of the hopper with respect to the incineration furnace. The hopper 10 is open at its bottom and communicates with a passage 18 defined at the interior of the tubular body 12. A push member 20 is slidably mounted in passage 18 and is actuated by a jack 22 for movement between a retracted position (FIG. 3) and an extended position respectively situated within the end portions 14 and 16 of the tubular body. The push member 20 has a section substantially equal to that of the passage 18 such that in the course of its travel between the retracted position and the extended position, the push member 20 is capable of forcibly advancing all of the accumulated waste in the tubular body under the hopper. The push member 20 and the passage 18 can have any shape whatsoever, for example, semi-cylindrical.

The tubular body 12 has at its upper portion situated between the furnace and the hopper 10, a flange 24 to which can be connected a blower (not shown) whose function is to introduce a current of air into the passage 18 in order to prevent flashback of the flame towards the hopper and to accelerate the combustion at the interior of the furnace.

Figure 3:
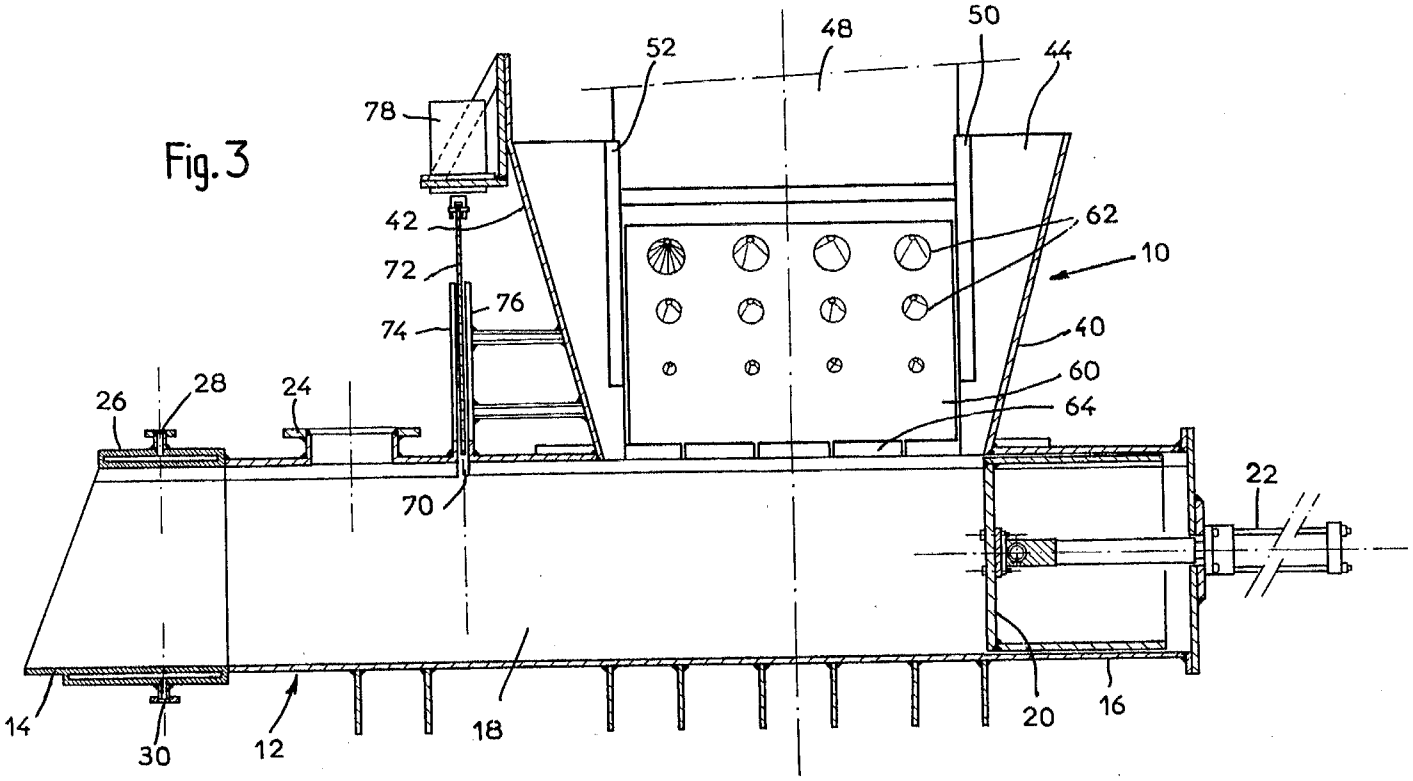
FIG. 3 is a sectional view taken along line III—III in FIG. 2.

As shown in FIGS. 1 and 3, the region of the end portion 14 of the tubular body 12 which is connected to the furnace forms a jacket 26 of refractory steel in which a cooling agent such as water is circulated. The jacket 26 has an inlet opening 28 and a discharge opening 30. The machine rests by the semi-cylindrical surface of the tubular body 12 on four supports 32,34,36,38 each comprising, for example, two columns 38', 38'' connected by a steel plate 38''' extending under the tubular body.

The hopper 10 is in the shape of a section of a square pyramid. Two of its opposed walls 40, 42 are fixed and its two other walls 44, 46 are movable or displaceable. The opposed walls 40,42 are fixed by any known means, for example, by welding to the upper wall of the tubular body 12.

The movable wall 44 is constituted, over the major portion of its surface, by a trap door 48 mounted for slidable movement upwardly and downwardly in a plane along substantially vertical slides 50,52. The trap door 48 is actuated by a jack 54 whose cylinder is fixed to a casing 56 carried by a beam 58 secured to the hopper. When the trap door is in lowered position, it completes the wall 44 of the hopper and when it is in raised position, as is shown in the drawings, it uncovers a crushing head 60 whose operative face is flat and covered with hardened pins 62 adapted to pierce hard objects, such as containers. The face of the crushing head 60 has a square shape of an area substantially equal to that of the bottom of the hopper. The head 60 is articulated at its lower edge to the base of the hopper by means of a hinge 64. Connected to the rear of the head 60 is a rod of a powerful jack 66, for example of twenty tons force, supported by the frame 34 and capable of pivotably moving the head 60 between a raised position at the rear of the trap door 48 and a lowered position at the base of the hopper.

The wall 46 of the hopper is constituted by a reinforced metallic door articulated at its lower edge to the hopper, the door 46 being pivotably movable by a jack 68 mounted on the frame 34, between a raised position where it forms a wall of the hopper and a lowered position where it closes the bottom of the hopper, thus completing the upper wall of the tubular body 12.

The tubular body 12 is provided with a transverse slot 70 in its upper wall between the wall 42 of the hopper and the end portion 14 of the tubular tube connected to the furnace. A vertical trap 72 is slidably movable in slot 70 to close the passage 18 of the tubular body downstream of the hopper and thus prevent flow back of the flame towards the hopper. The trap 72 is guided in its movement by two parallel and vertical plates 74,76 fixed at the edges of the slot 70. The trap 72 is actuated by a jack 78 mounted on a casing 80 carried by the wall 42 of the hopper.

The operation of the charging apparatus is as follows:

The hopper 10 is charged with products to be incinerated, by any suitable means, for example, by means of a rolling bridge equipped with a cabin in which are contained the control means for the different jacks and for drive of the bridge.

Before charging the hopper, the different elements of the machine will be in the following positions:

the push member 20 will be in its retracted position (FIG. 3);

the pivotable door 46 will be in raised position (FIG. 1);

the trap door 48 will be in lowered position and will cover head 60;

the trap 72 will be in lowered position;

dumped scrap will fill the hopper as well as the portion of the tubular body included between the push member 20 and the trap 72.

If the scrap contains voluminous objects such as containers or steel drums; the operator effects the following operations: raising the trap door 48; pivotably lowering the head 60 which will perforate and crush the scrap; retracting the head to its initial position; lowering the trap door 48 and lowering the pivotable door 46 to close the bottom of the hopper.

In the case where the scrap does not contain containers or steel drums, the operator only effects the lowering of the door 46. In these two cases, after the lowering of the door 46, the scrap is in a compressed state in the portion of the tubular body between the door 46, the push member 20 and the trap 72.

The operator then raises the trap 72 and actuates the jack 22. The push member 20 is displaced to the left in figure 3 thus advancing the charge of scrap contained in the tubular body towards the furnace.

When the push member 20 reaches the end of its forward travel, it is retracted to its original position whereafter the trap 72 is lowered and the pivotable door 46 is raised. The machine is then ready to receive a new charge.

Of course, the machine includes the necessary means to modify, according to the need, the speed of advance and of retraction of the jacks. Furthermore, the sequences of control of the jacks can be separately effected by manual action or according to an automatic sequence.

The machine according to the invention can be utilized in combination with a rotatable incinerator for burning domestic waste or for the treatment of certain industrial products and particularly products or scrap of large size and/or heterogeneous compositions without sorting or special preliminary preparation. By reason of its small size, compared to that of conventional incineration installations, and by reason of its modest cost and the ease of maintenance, the machine can be acquired even by small and medium size municipalities. With such machines, the incineration of worn tires can be effected without preliminary crushing. Furthermore, this incineration has the advantage of providing the heat necessary for the complete incineration of scrap of low caloric power. Thus, there is achieved a notable saving of energy.

What is claimed is:

1. A machine for charging furnaces with scrap to be incinerated comprising, a hopper for receiving various types of bulk scrap to be incinerated, said hopper having an open bottom, a rectilinear and horizontal tubular body having opposite ends, one of said ends being connected to the inlet of a furnace, said tubular body having an intermediate portion with an open top which communicates with said open bottom of the hopper, a push member slidably mounted in said tubular body, said tubular body having an interior passage which is substantially equal to that of said push member, said hopper having a first lateral wall constituted by a trap door capable of being raised and lowered, a crushing head pivotably connected to said hopper, said head being exposed when said lateral wall is raised and covered by said lateral wall when said wall is lowered, means for pivotably lowering said head with said trap door raised to compress the scrap against the bottom of the tubular body, and a second wall of the hopper facing said first wall and pivotably connected for movement between a raised position where said second wall forms a wall of the hopper and a lowered position where the second wall constitutes an upper wall closing the interior passage of the tubular body.

2. A machine as claimed in claim 1 wherein said hopper has a base and said crushing head has a section substantially equal to that of said base, said head including hardened pins projecting therefrom capable of piercing solid scrap.

3. A machine as claimed in claim 1 wherein said tubular body is provided with a transverse slot in a region between the hopper and the extremity connected to the furnace, a second trap door slidably mounted in said transverse slot for closing the tubular body downstream of the hopper and two parallel guide plates yieldably supporting said second trap door.

4. A machine as claimed in claim 3 wherein said tubular body is provided with an orifice downstream of said second trap door for introductin of a current of air into the interior of the tubular body.

5. A machine as claimed in claim 1 wherein said one end of the tubular body which is connected to the furnace includes a jacket of refractory material for circulation of cooling agent therein.

6. A machine as claimed in claim 1 comprising a support means including a plurality of supports each comprising two columns connected by a transverse beam serving for receiving said tubular body.

* * * * *